US007138048B1

(12) United States Patent
O'Connor et al.

(10) Patent No.: US 7,138,048 B1
(45) Date of Patent: Nov. 21, 2006

(54) APPARATUS AND METHOD FOR THE REMOVAL OF SOLIDS AND FLOATABLES FROM A WASTEWATER STREAM

(75) Inventors: Kelly O'Connor, West Orange, NJ (US); Laurens van der Tak, Bethesda, MD (US); Albert M. Wollmann, Gainesville, VA (US)

(73) Assignee: CH2M Hill, Inc., Englewood, CO (US)

( * ) Notice: Subject to any disclaimer, the term of this patent is extended or adjusted under 35 U.S.C. 154(b) by 820 days.

(21) Appl. No.: 10/137,130

(22) Filed: Apr. 30, 2002

(51) Int. Cl.
*E03F 5/14* (2006.01)

(52) U.S. Cl. ..... 210/136; 210/162; 210/304; 210/305; 210/306; 210/418; 210/512.1; 210/532.2; 210/787

(58) Field of Classification Search ..... 210/136, 210/154–162, 359, 409, 418, 340, 323.1, 210/320, 456, 499, 513, 521–522, 532.1, 210/532.2
See application file for complete search history.

(56) References Cited

U.S. PATENT DOCUMENTS

| | | | | | |
|---|---|---|---|---|---|
| 65,751 | A | | 6/1867 | Jacobs | |
| 419,887 | A | * | 1/1890 | Robinson | 210/162 |
| 454,185 | A | * | 6/1891 | Robinson | 210/162 |
| 1,644,532 | A | | 10/1927 | Ledyard et al. | |
| 1,999,637 | A | * | 4/1935 | Pettepher | 210/156 |
| 2,106,851 | A | * | 2/1938 | Nordell | 210/173 |
| 2,284,737 | A | * | 6/1942 | Hirshstein | 210/539 |
| 2,672,982 | A | * | 3/1954 | Alben | 210/155 |
| 3,285,415 | A | * | 11/1966 | Walker | 210/768 |
| 3,300,053 | A | * | 1/1967 | Peters | 210/519 |
| 3,415,378 | A | * | 12/1968 | Fukuda | 210/220 |
| 3,477,579 | A | * | 11/1969 | Turner | 210/156 |
| 3,677,409 | A | | 7/1972 | Ferm et al. | |
| 3,903,000 | A | | 9/1975 | Miura et al. | |
| 3,907,672 | A | * | 9/1975 | Milne | 210/605 |
| 3,933,654 | A | * | 1/1976 | Middelbeek | 210/521 |
| 4,021,347 | A | * | 5/1977 | Teller et al. | 210/195.1 |
| 4,092,249 | A | * | 5/1978 | La Gatta | 210/195.1 |
| 4,110,216 | A | * | 8/1978 | Wagnon et al. | 210/156 |
| 4,132,652 | A | * | 1/1979 | Anderson et al. | 210/536 |
| 4,139,471 | A | * | 2/1979 | Foti | 210/170 |
| 4,202,778 | A | * | 5/1980 | Middelbeek | 210/522 |
| 4,264,446 | A | | 4/1981 | Fregeau | |
| 4,325,823 | A | * | 4/1982 | Graham | 210/86 |
| 4,351,733 | A | | 9/1982 | Salzer et al. | |
| 4,680,113 | A | | 7/1987 | Eimer et al. | |
| 4,956,101 | A | * | 9/1990 | Holmberg | 210/780 |
| 4,957,633 | A | | 9/1990 | Suutarinen | |
| 5,679,265 | A | * | 10/1997 | Van Schie | 210/776 |

(Continued)

*Primary Examiner*—Robert James Popovics
(74) *Attorney, Agent, or Firm*—Swanson & Bratschun, L.L.C.

(57) ABSTRACT

An apparatus for removing particulates from a wastewater stream includes a chamber having a wastewater inlet and wastewater outlet which promotes a generally horizontal wastewater flow. A grating is provided in the chamber between the wastewater inlet and the wastewater outlet having a screen size for preventing the passage of particulates having greater than the select effective diameter from the wastewater inlet into the wastewater outlet. The grating is vertically inclined relative to the direction of the wastewater flow. A baffle within the chamber is configured to cooperate with the grating to generate a vortex in the wastewater having a velocity component parallel to the face of the grating which urges particles trapped by the grating along the grating toward a surface of the wastewater to suspend particles in the wastewater as the wastewater flows between the wastewater inlet and the wastewater outlet.

14 Claims, 3 Drawing Sheets

U.S. PATENT DOCUMENTS 5,770,057 A * 6/1998 Filion ..... 210/162
5,779,888 A * 7/1998 Bennett ..... 210/162
6,190,545 B1 2/2001 Williamson
6,217,777 B1 4/2001 Dahlquist et al.
6,337,016 B1 1/2002 Alper
6,409,914 B1 * 6/2002 Keppeler et al. ..... 210/151
6,679,994 B1 * 1/2004 Turco et al. ..... 210/767

* cited by examiner

APPARATUS AND METHOD FOR THE REMOVAL OF SOLIDS AND FLOATABLES FROM A WASTEWATER STREAM

TECHNICAL FIELD

The present invention is directed to wastewater treatment, and more particularly to an apparatus and method for the removal of solids and floatables entrained within a wastewater flow.

BACKGROUND ART

In many parts of the United States, wastewater run-off from storm events is allowed to flow into natural waterways. However, particularly in urban areas, this wastewater is likely to entrain relatively innocuous particulate materials, such as sand, gravel and potentially more objectionable particulates such as hypodermic needles and all manner of garbage. This can result in the discharge of highly undesirable debris into natural waterways.

The problem described above is exasperated in those areas having combined wastewater and sewage conveying systems. As used herein "wastewater" shall mean either storm run-off or combined sewage and storm run-off. Combined conveying systems are particularly common in the eastern half of the United States. During times of moderate precipitation, the combined storm wastewater and sewage can be treated at existing sewage treatment plants. However, when exceptional storm events occur, sewage treatment plants can become overwhelmed and it is necessary to release combined and untreated wastewater and sewage to natural waterways.

Many parts of the country have laws requiring removal of particulates greater than a select size from wastewater or combined wastewater/sewage flows before they can be discharged into a natural waterway. For example, New Jersey has mandated removal of particulates greater than 0.5 inch in size.

One known technology for particulate removal is offered by Fresh Creek Technologies. This technology uses a mesh bag that floats at the end of a pipe or in-line with a stream of wastewater. The bag collects solids and floatable materials of a size to great to flow through the mesh. Once the bag is full, a maintenance truck removes the bag to a landfill.

This mesh bag technology has several serious deficiencies. First, debris collected in the bag can create significant headloss by limiting the cross-sectional flow area and creating additional force upon the bag. If sufficient force is developed, this can damage the bag or otherwise result in a release of unacceptable solid and floatable materials to the natural waterway. Second, the nets are also unsightly and can lead to odor problems. Third, rodent activity, prevalent in sewer and conveying systems, can create tears in the bags that would result in a release of unacceptable solid and floatable materials to the natural waterway. The disposable bag also exacerbates waste disposal issues.

It is well known in the art that sieves or screens can be used to remove particulates from a liquid flow. However, known screening systems have a problem with debris buildup that can obstruct the flow of wastewater through the screening system during a storm event. This can lead to serious problems, including sewage backups in the conveying system that can result in the undesired discharge of unscreened wastewater through upstream catch basins and manholes to the natural waterway.

Eimer, U.S. Pat. No. 4,680,113, teaches a sieve arrangement for recovering cleaning particles from a cooling water stream downstream of a heat exchanger. The sieve arrangement taught by Eimer includes a screen or sieve across a flow of discharged water which is inclined relative to the discharged water flow. The screen is sized to collect cleaning particles on a leading surface. Eimer teaches providing a baffle in the water flow which creates a vortex impinging downward in a vertical direction on the cleaning particles to direct the cleaning particles downward into a recovery conduit. While suitable for the removal of these cleaning particles for reuse, such a system is not effective for wastewater solids removal because of the difficulty in continuously extracting solids of non-uniform size and shape likely to be encountered in wastewater runoff.

The present invention is directed toward overcoming one or more of the problems discussed above.

SUMMARY OF THE INVENTION

A first aspect of the invention is an apparatus for removing particulates from a wastewater stream. The apparatus includes a chamber having a wastewater inlet and wastewater outlet which promote a generally horizontal wastewater flow. A grating is provided in the chamber between the wastewater inlet and the wastewater outlet having a screen size for preventing the passage of particulates having greater than the select effective diameter from the wastewater inlet into the wastewater outlet. The grating is vertically inclined relative to the direction of the wastewater flow. A baffle within the chamber is configured to cooperate with the grating to generate a vortex in the wastewater having a velocity component parallel to the face of the grating which urges particulates trapped by the grating along the grating toward the wastewater surface to suspend particulates in the wastewater as the wastewater flows between the wastewater inlet and the wastewater outlet. At least one lengthwise partition may be provided in the chamber to define at least two screening vessels in hydraulic parallel between the wastewater inlet and the wastewater outlet. Each screening vessel includes a grating and a baffle as described above. The baffle may also define a screening vessel inlet. A valve is preferably operatively associated with the screening vessel for controlling wastewater flow to each screening vessel. The baffle may be a transverse partition between the wastewater inlet and the wastewater outlet, with the baffle extending from the top surface of the vessel downward to a point above the bottom surface of the vessel defining a liquid flow passage between the bottom of the baffle and the bottom surface of the vessel. The grating preferably is inclined between about 30–45 degrees from horizontal with a toe of the grating upstream. The baffle is preferably spaced about 1.5 times an effective diameter of the wastewater inlet from the wastewater inlet.

In one embodiment, a pivotal connection is provided between the grating and the chamber floor which enables variation of the vertical incline of the grating between about 30 degrees to greater than 85 degrees from horizontal. When pivoted to a more vertical orientation, the grating may be backwashed for cleaning purposes. A one way check valve may be operatively associated with the outlet to prevent backflow into the wastewater outlet.

A second aspect of the invention is a method of removing particulates from a wastewater stream. The method includes flowing a wastewater stream in a horizontal flow path having a surface, providing a grating in the horizontal flow path vertically inclined relative to the horizontal flow path with a leading toe upstream, forming a vortex in the horizontal flow path having a velocity component parallel to the face of the grating which urges particles trapped by the grating along the grating toward the surface of the horizontal flow path. The particulates may include floatable materials and the vortex functions to keep the floatable material suspended within the horizontal flow path upstream from the grating. The method may further include providing at least two vertically inclined gratings and selectively directing the horizontal flow path to the gratings. The particulates may also include solid material, which settle to a sump area within the chamber. When stormwater flow subsides, all material descend to a sump area in the chamber for ease of removal.

The apparatus for removing solids and floatables from a wastewater stream in accordance with the present invention provides a system which effectively self-cleans the screen during a storm event to allow for the efficient flow of wastewater through the solids removal facility. The apparatus creates a vortex which tends to suspend particulates, particularly high volume floatable particulates, by imparting a force along the grating directed toward the wastewater surface on the particulates trapped by the grating. Among the advantages this system provides is elimination of the need to have the removal facility continuously manned during a storm event to prevent blockage. The apparatus can also be installed below grade and effectively concealed from view, meaning that its use will not degrade the aesthetic appeal of the waterway shore. When desirable to clean the apparatus, the grating can be pivoted to be substantially vertical to facilitate effective backwashing of the grating to remove trapped solids. Provision of screening chambers in parallel allows for flow to be diverted from a select screen chamber during cleaning and maintenance. This feature enhances safety for the maintenance personnel.

DETAILED DESCRIPTION OF THE PREFERRED EMBODIMENT

Figure 1:
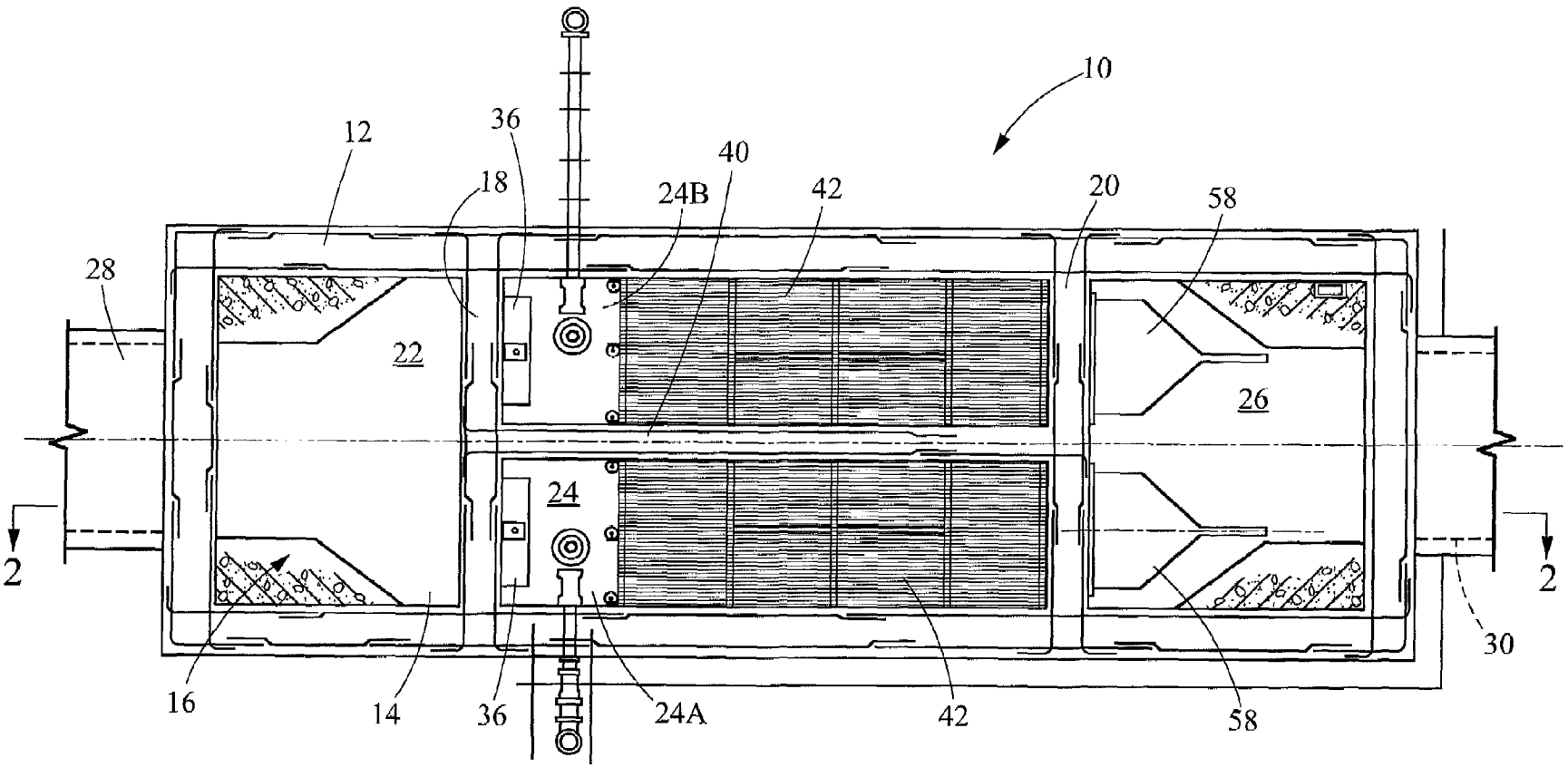
FIG. 1 is a plan view of a solid/floatable removal facility in accordance with the present invention.
Figure 2:
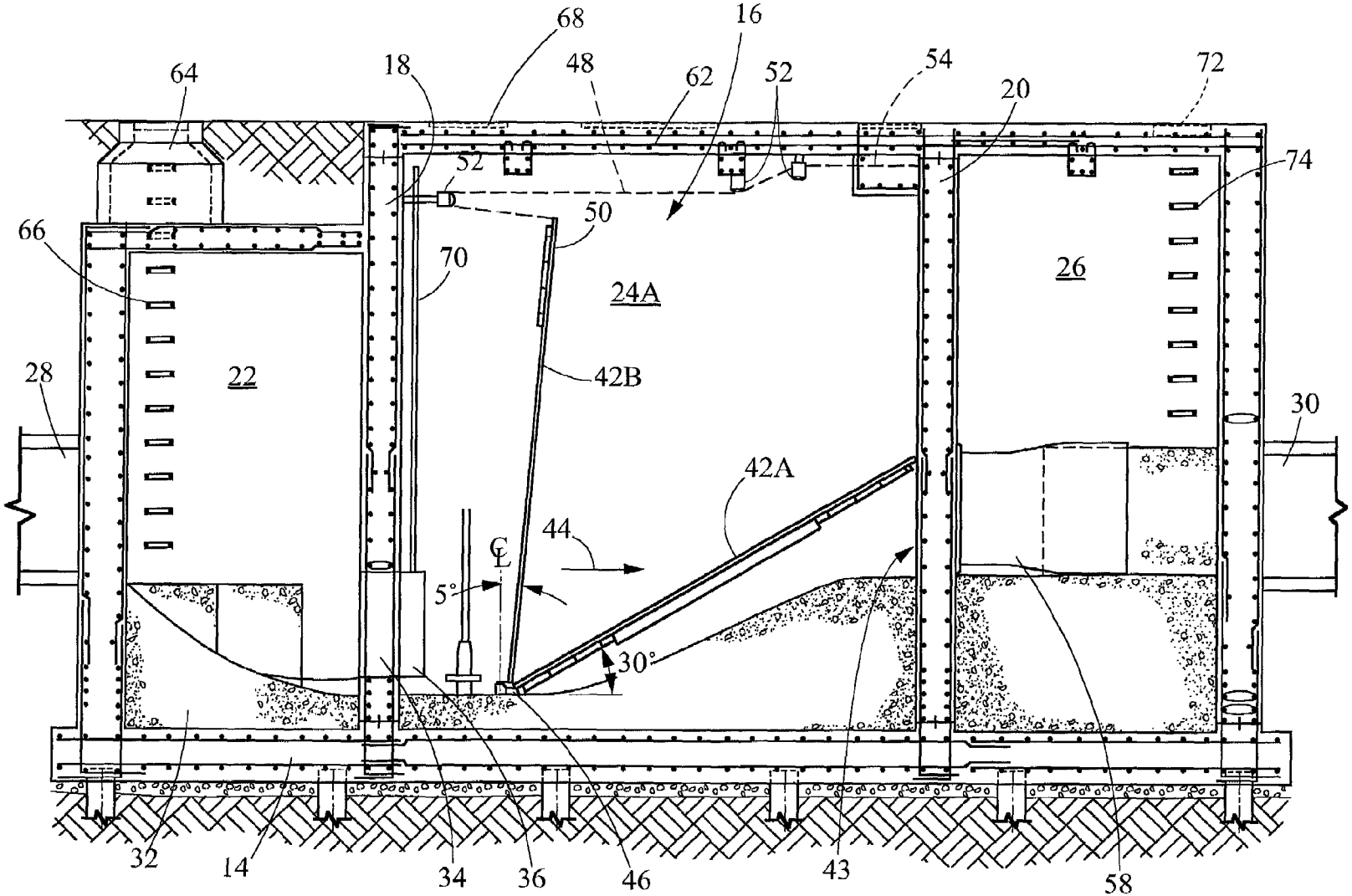
FIG. 2 is a vertical cross section taken along line 2—2 of FIG. 1.

An apparatus for removing solid and floatable particulates from a wastewater stream is shown in a plan view with the cover removed in FIG. 1. The apparatus consists of a sidewall 12 and bottom wall 14 defining a chamber 16. The chamber 16 is divided by a first transverse partition 18 and a second transverse partition 20 into an inlet vessel 22, a screening vessel 24 and an outlet vessel 26. The chamber 16 also includes a wastewater inlet 28 and a wastewater outlet 30. Referring to FIG. 2, a concrete fillet 32 lies between the wastewater inlet 28 and the bottom wall 14. With continued reference to FIG. 2, the first partition 18 has an opening 34 between a bottom of the first partition 18 and the bottom wall 14. A sluice gate with anon-rising stem 36 is operatively associated with the opening 34 to selectively open and occlude the opening. In some applications a sluice grating with a rising stem may be preferred.

In a preferred embodiment, a lengthwise wall 40 divides the screening vessel 24 into a first screening vessel 24A and a second screening vessel 24B. Each vessel is identical to the description of the screening vessel 24 above, including having a sluice gate 36 operatively associated therewith.

Within each screening vessel 24A and 24B is a grating or screen 42. Referring to FIG. 2, grating 42 is situated between the inlet 28 and the outlet 30, and more particularly between the opening 34 into the screening vessel and a screening vessel exit 43. The grating 42 is vertically inclined relative to a horizontal flow path of the wastewater illustrated by arrow 44, with a toe of the grating 42 upstream. The grating 42 is connected by a hinge 46 at its toe to the bottom wall 14 of the screening vessel 24A, 24B. A cable or chain 48 is connected between a distal end 50 to a motorized winch 54 via a series of pulleys 52. By action of the winch, the grating 42 can be inclined from an operative position at approximately a 30–45 degree angle from horizontal in the direction of wastewater flow 44 to a backwash position of approximately 85 degrees from horizontal, as illustrated in FIG. 2. The precise angle in the operative position is a function of the system hydraulics are designed to optimize the upsweeping motion along the grating, which causes particulates to be pushed to the top of the grating as well as to minimize headloss across the grating. The grating angle is also a function of the allowable difference in elevation between the bottom wall 14 and the top wall 62. Hydraulic testing shows an operative angle in the range of 30–45 degrees to provide suitable results, with an angle of about 30 degrees being preferred. Angles of up to 45 degrees may be acceptable if space constraints require greater angels. While angles of greater than 45 degrees are considered within the scope of the invention, such angles are generally not preferred because they have been found to not produce as effective a scrubbing action. Within the outlet vessel 26 resides a one way check valve 58 operatively associated with the outlet 43 of each screening vessel 24A, 24B. The check valves 58 are both output into the outlet vessel 26 which in turn is in communication with the wastewater outlet 30.

The chamber 16 is intended for installation below grade. When it is thus deployed, it is desirable to include a chamber top 62. In such an embodiment, a manhole access 64 is provided into the inlet vessel 22 and a ladder 66 is provided on the sidewall 12 to facilitate access for cleaning and maintenance. A manhole 68 may also be provided in each screening vessel 24A, 24B. In a like manner, a manhole 72 and a ladder 74 may be provided in the outlet vessel 26.

In use, wastewater enters the chamber through the wastewater inlet 28. With the sluice gate 36 open, water passes under the first transverse partition 18 through the opening 34. With the grating 42 disposed in its operative position 42A of FIG. 2, solid and floatable particulate matter of a size greater than the select screen size of the grating 42 are trapped in the screen chamber 24A and screened wastewater is allowed to flow through outlet 43, through the one way check valve 58 and ultimately out the chamber outlet 30.

Figure 3:
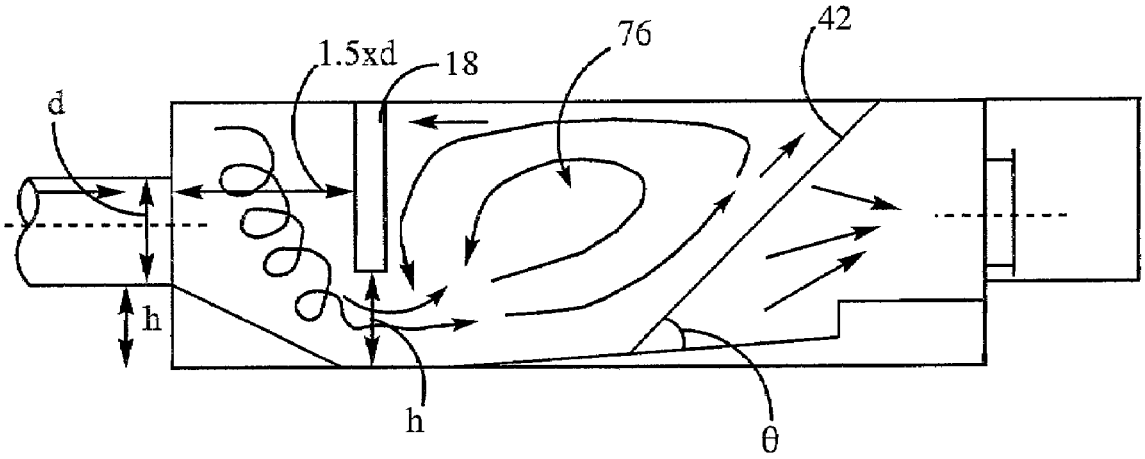
FIG. 3 is schematic representation of a vortex created by a baffle of the invention impinging a grating.

Referring to FIG. 3, as the wastewater flows through the opening 34 the first transverse partition 18 functions as a baffle which, in cooperation with the grating 42 causes formation of a vortex 76 in the wastewater which has a velocity component parallel to the grating 42 which urges particulates toward the wastewater surface and functions to suspend particulates in the wastewater as the wastewater flows between the wastewater inlet and the wastewater outlet. This vortex has the effect of removing particulates, in particular floatable particulates from the grating 42 and causing their re-suspension within the screening chamber 24A to prevent obstruction of the grating 42. Thus, during a rain event causing a wastewater flow in the chamber 16, the grating 42 is effectively self-cleaning so as to prevent significant obstruction of wastewater flow through the grating 42.

The vortex 76 is generated due to barriers in the wastewater flow path, namely the baffle and the grating. The baffle and the grating cooperate to create a disturbance which destabilizes the wastewater flow stream and causes vorticity (i.e., the curl of the velocity vector). Relatively large changes in velocity over a small space in distance increases the vorticity. Here, the baffle acts to increase the velocity of liquid flow and the grating acts as a disturbance in the flow stream creating sheer stresses in the liquid flow causing the vortex action to occur. It has been found that the angle of the grating, the position of the baffle relative to the inlet and the size of the opening created by the baffle can be manipulated to produce a desired result. As a result of two dimensional modeling as well as physical modeling and test runs with the grating at different angles as well as variation in the location of the baffle relative to the inlet and the opening size, certain desirable design criteria were identified. First, it was found that spacing the baffle approximately 1.5 times the effective diameter of the influent pipe helped to minimize headloss and created an area for floatables to accumulate upstream and adjacent the baffle. Second, the height of the opening defined by the baffle was found to be optimum at about 48 inches above the bottom wall of the chamber. Moreover, it was found that having the bottom of the baffle the same elevation above the bottom wall of the chamber as the bottom of the influent pipe is also beneficial. With regard to the screen angle, testing found a 30 degree angle to provide a large surface area and create an effective vortex. However, if space constraints apply, angles of up to 45 degrees were found to yield satisfactory results. However, once the grating angle exceed 45 degrees, the vortex effect was found to diminish.

At the conclusion of a storm event, or as part of regular maintenance, the grating 42 can be raised via the motorized winch 54 and chain 48 to the vertical position 42B, at which time the grating 42 can be cleaned by high pressure backwash. Although not shown, debris can be removed from the screening vessel 24 and/or inlet vessel 22 by lowering a vacuum hose from a vacuum truck and sucking up the debris.

As discussed above, each of screening vessels 24A and 24B has a sluice gate with a non-rising stem 36 operatively associated with the opening 34. This allows for closing of the opening 34 during cleaning and maintenance of a screening vessel 24A, 24B without risk of harm to the service technician in the event of an unexpected storm event. Obviously, either or both screening vessels may accept wastewater flow as needed to accommodate the wastewater entering the inlet 28.

Set forth below are dimensions of one chamber having two screening vessels in accordance with this invention that was found to function effectively. This device had the following design criteria:

Flow: 60 cubic feet per second
Velocity: 2–6 feet per second
Headloss: 1.5 feet
Inlet diameter: 7 feet by 4 feet-9 inches
Distance of baffle from inlet: 9 feet
Screen angle: 32 degrees
Screen length: 18 feet, 7 inches
Elevation of inlet pipe bottom from bottom of inlet chamber: 4 feet
Height of opening of low baffle: 4 feet
Width of each screening vessel: 5 feet-6 inches
Total width of chamber: 12 feet-4 inches The apparatus for removing solid and floatable particulates from a wastewater stream in accordance with the present invention may be deployed below grade and screened with landscaping or otherwise concealed. This overcomes a significant objection to prior art solid and floatable removal systems, such as the Fresh Creek net facility. The combination of the baffle defined by the first transverse partition 18 and the vertically inclined grating 42 results in the formation of a vortex having a vertical element which directs particulates along the grating toward the surface so as to maintain the particulate matter in suspension and prevent blockage of the grating 42. Cleaning and maintenance of the grating 42 is facilitated by providing a screening chamber that can be sealed off from wastewater flow. The grating 42 can be tipped to a substantially vertical orientation where it can be readily backwashed. The self cleaning nature of the grating facilitated by the baffle allows this system to be deployed without the need of manual supervision during a storm event. Also, no external power must be provided to the system during a storm event for this self cleaning to be actuated.

The invention claimed is:

1. An apparatus for removing particulates from a wastewater stream, the apparatus comprising:

a chamber having a wastewater inlet and a wastewater outlet promoting a generally horizontal wastewater flow;

a grating in the chamber between the wastewater inlet and the wastewater outlet having a screen size for preventing the passage of particulates having greater than a select effective diameter from the wastewater inlet into the wastewater outlet, the grating being vertically inclined relative to the direction of wastewater flow; and a baffle in the chamber, the baffle being configured to cooperate with the grating to generate a vortex in the wastewater having a velocity component parallel to the face of the grating which urges particles trapped by the grating along the grating surface toward a surface of the wastewater to suspend particulates as the wastewater flows between the wastewater inlet and the wastewater outlet.

2. The apparatus of claim 1 further comprising a pivotable connection between the grating and the chamber enabling variation of the vertical incline of the grating.

3. The apparatus of claim 2 wherein the pivotable connection provides for an angle of vertical incline of between about 30 degrees to greater than 85 degrees from horizontal.

4. The apparatus of claim 1 further comprising at least one lengthwise partition in the chamber defining at least two screening vessels in hydraulic parallel between the wastewater inlet and the wastewater outlet, each screening vessel having a grating and a baffle.

5. The apparatus of claim 4 wherein each baffle defines a screening vessel inlet.

6. The apparatus of claim 4 further comprising a valve operatively associated with each screening vessel for controlling wastewater flow to each screening vessel.

7. The apparatus of claim 1 wherein the chamber is located below grade and accessible from above the chamber.

8. The apparatus of claim 1 wherein the baffle comprises a transverse partition between the wastewater inlet and the wastewater outlet, the baffle extending from a top surface of the chamber downward to a line above a bottom surface of the chamber and defining a liquid flow passage between a bottom edge of the baffle and a bottom surface of the chamber.

9. The apparatus of claim 1 further comprising a one-way check valve operatively associated with the outlet to prevent backflow into the outlet.

10. The apparatus of claim 1 further comprising a fillet in the chamber between the wastewater inlet and a floor of the chamber.

11. The apparatus of claim 1 wherein the grating has an upstream toe attached to the chamber bottom and the grating is vertically inclined between about 30 degrees to about 45 degrees from horizontal when in an operative position.

12. The apparatus of claim 11 wherein the baffle comprises a transverse partition between the wastewater inlet and the grating, the baffle extending from the top surface of the chamber downward to a bottom edge above a bottom surface of the chamber defining a liquid flow passage therebetween.

13. The apparatus of claim 12 wherein the wastewater inlet has an effective diameter and the baffle is located about 1.5 times the effective diameter from the wastewater inlet.

14. The apparatus of claim 13 wherein the wastewater inlet has a bottom a select distance above the chamber bottom surface and the bottom edge of the baffle is about the select distance above the chamber bottom surface.

* * * * *